US007421231B2

(12) United States Patent
Bessho

(10) Patent No.: US 7,421,231 B2
(45) Date of Patent: Sep. 2, 2008

(54) IMAGE FORMING APPARATUS

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 11/350,875

(22) Filed: Feb. 10, 2006

(65) Prior Publication Data

US 2006/0198660 A1 Sep. 7, 2006

(30) Foreign Application Priority Data

Mar. 2, 2005 (JP) ..... 2005-057009

(51) Int. Cl.
*G03G 15/01* (2006.01)
*G03G 15/20* (2006.01)

(52) U.S. Cl. ..... 399/223; 399/341

(58) Field of Classification Search ..... 399/223, 399/341

See application file for complete search history.

(56) References Cited

U.S. PATENT DOCUMENTS

| | | | | |
|---|---|---|---|---|
| 5,260,753 | A | 11/1993 | Haneda et al. | 355/282 |
| 5,506,671 | A | 4/1996 | Buts et al. | 355/326 R |
| 2006/0127112 | A1 * | 6/2006 | Ono | 399/69 |

FOREIGN PATENT DOCUMENTS

| | | | |
|---|---|---|---|
| JP | 63-58374 | | 3/1988 |
| JP | 4-278967 | | 5/1992 |
| JP | 4-204670 | | 7/1992 |
| JP | 5-232840 | | 9/1993 |
| JP | 7-72696 | | 3/1995 |
| JP | 10-186929 | A | 7/1998 |
| JP | 11-249375 | A | 9/1999 |
| JP | 2002-49264 | A | 2/2002 |
| JP | 2005055517 | A * | 3/2005 |

OTHER PUBLICATIONS

Notification od Reason for Refusal issued on Jan. 29, 2008, in Japanese Patent Application No. 2005-057009.

* cited by examiner

*Primary Examiner*—David M. Gray
*Assistant Examiner*—Ruth N Labombard
(74) *Attorney, Agent, or Firm*—Fitzpatrick, Cella, Harper & Scinto

(57) ABSTRACT

An image forming apparatus which improves uneven gloss occurring at the step of fixing a transparent toner is provided with an image bearing member on which a latent image is formed, a transparent toner image forming device for forming a transparent toner image on the image bearing member, a transferring device for transferring the formed transparent toner image onto a recording material, a fixing device for fixing the transferred transparent toner image on the recording material, and a controller for controlling the bearing amount of the transparent toner image formed on the image bearing member, and the controller controls a condition for forming the transparent toner image to change the bearing amount of the transparent toner image in accordance with the fixing temperature of the fixing device.

12 Claims, 7 Drawing Sheets

IMAGE FORMING APPARATUS

BACKGROUND OF THE INVENTION

1. Field of the Invention

The invention relates to an image forming apparatus for forming an image by the use of an electrophotographic printing method, an electrostatic recording method or the like, and particularly to an image forming apparatus such as a copying machine, a printer or a facsimile apparatus.

2. Description of Related Art

As an example of an image forming apparatus for forming an image by an electrophotographic printing method, such as a copying machine or a laser beam printer, there is a full-color image forming apparatus adapted to form an image by superimposing Y(yellow), M(magenta), C(cyan) and Bk(black) color component images one upon another.

A color image by color toners formed in the manner described above has its surface smoothed when it is heated and fixed by a fixing apparatus and therefore, has glossiness differing from that of the surface of paper. Therefore, the glossiness of an image portion by the toners is high and the glossiness of a non-image portion is low and thus, it is difficult to uniformize the glossiness on a recording material.

So, as a technique of suppressing such a difference in glossiness between the image portion and the non-image portion, there has been proposed a method of using transparent toners besides the above-mentioned color toners (Japanese Patent Application Laid-open No. S63-58374, Japanese Patent Application Laid-open No. H04-278967, Japanese Patent Application Laid-open No. H04-204670, Japanese Patent Application Laid-open No. H05-232840 and Japanese Patent Application Laid-open No. H07-72696). Specifically, it attempts to form a transparent toner image on the non-image portion to thereby reduce the difference in glossiness from the image portion.

However, the temperature of a fixing roller becomes different between the fixing roller immediately before the heat thereof is taken away by a recording material and the fixing roller immediately after the heat thereof has been taken away by the recording material, and there is the possibility that a faulty image may occur due to such a temperature fall. Specifically, in the first round (hereinafter referred to as the first revolution) wherein the fixing roller contacts with the recording material (the first sheet in a job wherein image formation is continuously effected on a plurality of recording materials), the fixing roller is not in contact with the recording material immediately before and therefore, there is no temperature fall, but in the next round (hereinafter referred to as the second revolution) of the fixing roller, a temperature fall occurs due to the recording material. That is, a difference occurs between the fixing capability of the fixing roller in the first revolution thereof and the fixing capability of the fixing roller in the second revolution (and subsequent revolution) thereof, and there has been the possibility that a faulty image may occur due to this. As the result, glossiness becomes high if the fixing temperature is high, and conversely glossiness becomes low if the fixing temperature is low and thus, uneven glossiness occurs to an image.

In the apparatuses described in the above-mentioned publications, a transparent toner image is not formed with the above-described reduction in the fixing capability from the first revolution of the fixing roller to the second revolution (and subsequent revolutions) thereof taken into account and therefore, there is the possibility of uneven gloss occurring to the image. That is, the image formed on the recording material assumes a state in which a portion of high glossiness and a portion of low glossiness are mixedly present, there is the possibility of the quality of image being lowered.

SUMMARY OF THE INVENTION

It is an object of the present invention to provide an image forming apparatus which can suppress uneven gloss from occurring to an image.

It is also an object of the present invention to provide an image forming apparatus having image forming means for forming a toner image on a recording material, the image forming means being capable of forming on the recording material a toner image for gloss for improving the glossiness of the image, image heating means for heating the toner image on the recording material in a nip portion, and changing means for changing the toner amount per unit area of the toner image for gloss to suppress any change in glossiness resulting from any change in the temperature of the image heating means.

It is a further object of the present invention to provide an image forming apparatus having image forming means for forming a toner image on a recording material on the basis of image information, the image forming means being capable of forming on the recording material a toner image for gloss for improving the glossiness of the image, image heating means for heating the toner image on the recording material in a nip portion, and changing means for changing the toner amount per unit area of the toner image for gloss irrespective of the image information.

Further objects of the present invention will become apparent from the following detailed description when read with reference to the accompanying drawings.

DETAILED DESCRIPTION OF THE PREFERRED EMBODIMENTS

The best aspect for carrying out this invention will hereinafter be described in detail by way of example with reference to the drawings and embodiments. However, the dimensions, materials, shapes, relative arrangement, etc. of constituent parts described in these embodiments are not intended to restrict the scope of this invention thereto unless particularly described. Also, the materials, shapes, etc. of members once described in the following description are similar to those first described unless particularly newly described.

Embodiment 1

Figure 1:
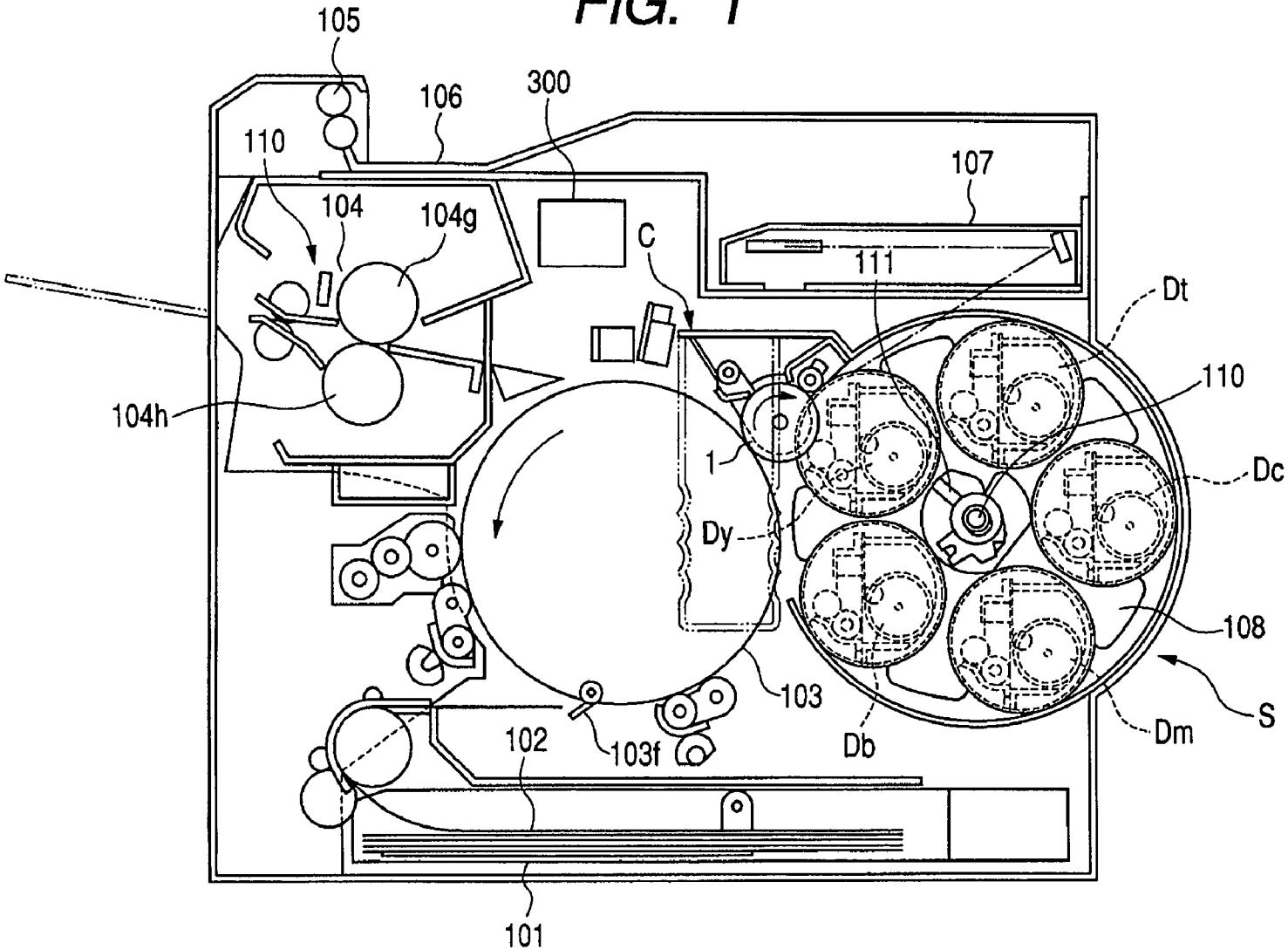
FIG. 1 is a schematic cross-sectional view of an image forming apparatus according to an embodiment of the present invention.

FIG. 1 shows the general construction of a multi-color image forming apparatus (printer) which can suitably adopt the present invention. The image forming apparatus of the present embodiment comprises, as described below, first image forming means for forming a normal toner image on a recording material in accordance with image information of an original; and second image forming means for forming a toner image for glossiness for improving a glossiness of an image. Incidentally, where the image information of the "original" designates image information read by a below-described original reading apparatus when the image forming apparatus is used as a copying machine, and designates image information input from a below-described described host computer when the image forming apparatus is used as a printer. That is, even if the image forming apparatus of the present embodiment is either a copying machine or a printer, the image forming apparatus forms a normal toner image on the basis of the image information from an original source.

A recording material 102 fed from a feeding portion 101 has its leading end nipped by the gripper 103*f* of a transfer drum 103 and is held on the outer periphery of the transfer drum 103 as transferring means.

Image information to be outputted is inputted from a host computer network-connected to the image forming apparatus by a LAN cable to the interface of the image forming apparatus.

On the other hand, a photosensitive drum 1 as an image bearing member carried on a drum cleaner unit C has its surface uniformly charged by a primary charging device.

Then, a CPU 300 as controlling means operates an optical unit 107 as latent image forming means on the basis of the image information received by the interface. As the result, electrostatic latent images of respective colors (yellow, magenta, cyan, black and transparent) are formed on the image bearing member (photosensitive drum) 1 of the drum cleaner unit C by this optical unit 107.

In a case where the image forming apparatus is a copying machine carrying thereon an original reading apparatus for reading the image of an original, the above-described image information means the image information of the original. That is, in this case, the CPU 300 operates the optical unit 107 on the basis of the input of a signal indicative of the image information from the reading apparatus, whereby the electrostatic latent images are formed on the photosensitive drum.

A developing device selecting mechanism S is constituted by a developing cartridge holding member 108 rotatable about a shaft 110 parallel to the shaft of the image bearing member 1, a pressure member 111 for pressing developing cartridges Dy, Dm, Dc, Db and Dt as developing means toward the image bearing member 1 in a developing portion and positioning them, a controlling and driving mechanism (not shown) for rotating the holding member 108 and selectively moving the developing cartridges Dy, Dm, Dc, Db and Dt, a driving mechanism (not shown) for maintaining the developing cartridges Dy, Dm, Dc, Db and Dt in a particular posture, etc.

As each developing cartridge, use is made of a so-called two-component developing apparatus using a mixture of a toner and a carrier to thereby achieve a high quality of image and a long life. The present invention is also applicable to a so-called mono-component developing apparatus using chiefly a toner.

Next, toner images developed for the respective colors by the developing device selecting mechanism S are transferred onto the recording material 102 held on the transfer drum 103. Then, a multi-color image is formed on the recording material 102, whereafter the recording material 102 is separated from the transfer drum 103, and is conveyed to a fixing unit 104. The recording material 102 to which the toner images have been transferred has the multi-color image thereon fixed in the fixing unit 104 as fixing means, and is discharged from a discharging portion 105 to a discharging tray portion 106. In the present embodiment, the developing cartridges and the transfer drum together constitute image forming means, which forms a toner image on the recording material.

In the present embodiment, after the formation of the yellow, magenta, cyan and black color images, a transparent toner image by a transparent toner T as a toner for gloss for improving the glossiness of the image is selectively formed on the non-image portion of the image bearing member 1 (excluding the so-called blank portions of the end portions the recording material) by the cartridge Dt provided with the transparent toner T, and is transferred to the recording material 102. Thereby, the difference in gloss between the image portion on which the colored toners (in the present embodiment, the yellow, magenta, cyan and black toners) are present and the non-image portion on which the colored toners are absent is alleviated, and a multi-color image of high gloss can be obtained.

Here, the transparent toner T can fill the difference between the gloss of the image portion (toner portion) and the gloss of the non-image portion to thereby achieve uniform gloss as the whole image (form a toner image having a small differences in glossiness) and also, becomes capable of filling the unevenness of the recording material and alleviating the difference in unevenness to thereby give birth to gloss, and increase the glossiness of the whole image.

As the way to use such a transparent toner, the present embodiment adopts a technique of selectively forming a transparent toner image on the non-image portion of an image-formed area formed by the colored toner images (excluding a portion corresponding to the so-called blank on the recording material) on which the colored toner images are not formed. As another way to use the transparent toner, there may be adopted a technique of forming a transparent toner image on both of the image portion on which the colored toner images are formed and the non-image portion on which the colored toner images are not formed so that the difference in glossiness by the toners between the image portion formed by the colored toner images and the non-image portion on which the colored toner images are not formed may become small.

In order to increase the glossiness of the whole image, besides the use of the transparent toner T, use may be made of a toner having such a degree of hue as will not greatly change the hue of the recording material itself. Specifically, when use is made of a recording material of 80 g of CLC (plain paper for image forming produced by Canon, Inc.), it is possible to use a toner (e.g. a white toner) of such a hue that the difference thereof from the hue of the CLC 80 g paper itself is 6.5 or less (CLC is a trademark). This hue difference can be obtained by detecting reflected light from the recording material, and in the present embodiment, grade-B allowance (Japan Color Research Institute) is used as this hue difference.

In the present embodiment, use is made of the former method of putting the transparent toner on all portions, which are blank areas of images on which colored toner are not put. Of course, the latter method toner can also be applied to the image forming apparatus according to the present invention. Preferably, use may be made of a toner which becomes colorless and transparent when a toner image is fused and fixed on a recording material by the fixing unit 104.

The elements described above are the main constituents of the image forming means for forming a toner image. Description will hereinafter be made of the fixing unit as fixing means (image heating means) for heating and pressurizing the toner image formed on the recording material to thereby effect a fixing process.

The fixing unit 104 will now be described in detail. In FIG. 1, a fixing roller 104*g* as a heating rotary member (image heating means), in order to cope with the thickness (several μm to several tens of μm) of multiplex toners of a single color to four colors of the color image, has an elastic layer of silicone rubber or the like having a thickness of several tens of μm or greater provided on a mandrel of aluminum or the like. The circumferential length of the fixing roller is made shorter than the length of a usually used recording material in the conveying direction thereof except a special recording material of a very small size. Accordingly, as will be described later, there is a case where the temperature of the fixing roller lowers during a fixing process for a recording material.

A pressure roller 104*h* which is also recording material conveying means is disposed so as to be brought into pressure contact with the fixing roller 104*g*, and they are rotated relative to each other and nip and convey the recording material bearing an unfixed transparent toner image thereon by the pressure contact portion therebetween. A halogen heater (not shown) which is heating means is disposed in the interior of each of the fixing roller 104*g* and the pressure roller 104*h* and therefore, the recording material and the unfixed transparent toner image thereon are subjected to pressurization and heating through the pressure roller 104*h*, and the toner image is fixed on the recording material, which is then discharged.

Figure 2:
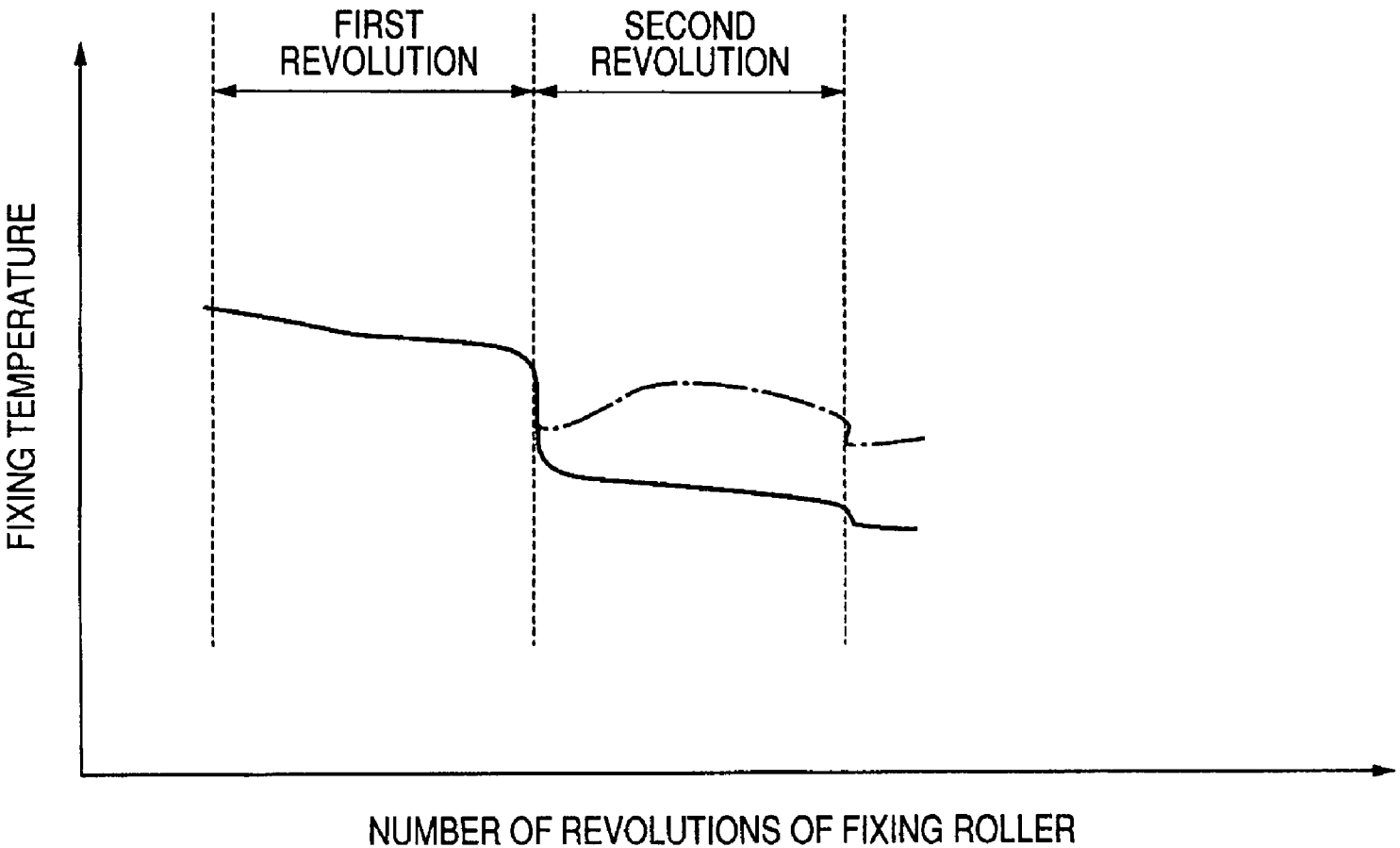
FIG. 2 shows the temperature transition in the first revolution and second revolution of a fixing roller.

Accordingly, the heat of the fixing roller 104*g*is taken away by the recording material and the toner image thereon to thereby cause the lowering of the temperature. FIG. 2 shows the transition of the fixing temperature during the first revolution and second revolution of the fixing roller. The first revolution and second revolution of the fixing roller herein referred to refer to the revolutions of the fixing roller during which, when a job of continuously forming images on a plurality of recording materials with the input of an image forming signal is started, the first recording material in this job contacts with the fixing roller. That is, the revolution during which this first recording material contacts at first is the "first revolution" of the fixing roller, and the next revolution is the "second revolutions" of the fixing roller. As indicated by solid line in FIG. 2, a difference in the fixing temperature occurs to the fixing roller 104*g* between the revolution thereof and the second revolution thereof. Also, the temperature transition indicated by broken line in FIG. 2 is indicative of the temperature transition when above-described the difference in the fixing temperature between the first revolution and the second revolution has been alleviated by the use of a known method of detecting the temperature of the fixing roller by a thermister (temperature detecting element), and controlling the supply of electric power to the halogen heater on the basis of the result of this detection by controlling means (CPU 300).

The temperature difference between the first revolution and second revolution of the fixing roller is alleviated to a certain degree by using such a known method, but to raise the temperature of the fixing roller to a predetermined temperature, a constant time is required and therefore, there occurs a portion which cannot follow a substantially binary change in the first revolution and the second revolution.

Also, the uneven gloss of the image formed on the recording material exhibits a tendency similar to the above-described transition of the fixing temperature, and in the state indicated by solid line, the difference between the temperature at which the fixing roller fixes the toner image on the recording material during the first revolution thereof and the temperature at which the fixing roller fixes the toner image on the recording material during the second revolution thereof reaches about 10 degrees. In such a situation, in a conventional image forming apparatus wherein the bearing amount of the transparent toner is not changed in accordance with the temperature fall of the fixing roller during the first revolution and second revolution thereof, uneven gloss occurs to the formed image.

So, in the present embodiment, in view of the above-noted problem, the uneven gloss due to the change in the fixing temperature of the fixing roller 104*g* during the first revolution thereof and the fixing temperature of the fixing roller 104*g* during the second revolution is improved by controlling a condition for forming the transparent toner image to change the bearing amount of the transparent toner image by changing means (CPU 300) comprising calculating means, storage means or the like. That is, the toner amount per unit are of the transparent image formed in advance on the recording material to suppress any change in the gloss of the image resulting from any change in the temperature of the fixing roller is changed by the changing means comprising calculating means, storage means or the like and is suppressed thereby. The details of this will be shown below.

Figure 3:
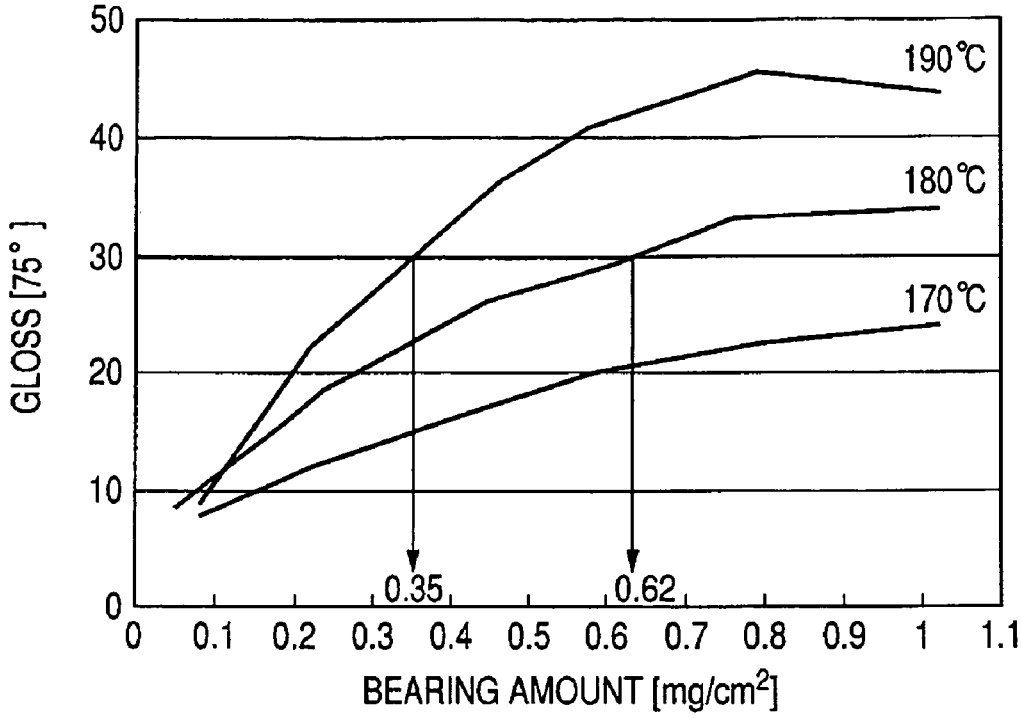
FIG. 3 shows the relation between a bearing amount and gloss.

FIG. 3 shows the relation between the mass (hereinafter called the bearing amount) of the transparent toner per unit area formed on the recording material and the gloss thereof at each fixing temperature. The measured values of the gloss are by reflection of 75°. As is apparent from FIG. 3, the relation between the bearing amount of the transparent toner and the gloss is in a direction for decreasing the influence of the reduction in the gloss by the unevenness of the surface of the recording material. Therefore, in the present embodiment, in the area shown in FIG. 3 (wherein the bearing amount is 0.8 $mg/cm^2$ or less), the value of the gloss relative to the bearing amount has a substantially rightwardly upward relation, and the area which is high in the fixing temperature is also high in gloss. This area is changed by various constructions, and is not restricted to this example.

In the present embodiment, on the basis of FIG. 3, the bearing amount of the transparent toner per unit area on the recording material is made greater on the trailing end side of the recording material in the conveying direction thereof than on the leading end side thereof. More simply, in accordance with the fall of the fixing temperature, the bearing amount of the transparent toner image per unit area on the recording material 102 fixed by the fixing roller 104*g* during the second and subsequent revolutions thereof may be increased (changed) relative to the bearing amount of the transparent toner image per unit area on the recording material 102 fixed by the fixing roller 104*g* during the first revolution thereof. Thereby, the bearing amount of the transparent toner can be made proper in accordance with the change in the fixing temperature during the first revolution and second revolution of the fixing roller 104*g*, and the occurrence of uneven gloss due to the change in the fixing temperature of the fixing roller can be suppressed to thereby achieve a uniform glossy feeling.

Specifically, when an image is formed on a recording material of basis weight of 80 $g/m^2$, if the surface temperature of the fixing roller 104*g* during the first revolution thereof in which the recording material 102 passes is 190 degrees, the surface temperature thereof becomes 180 degrees during the second revolution, thus falling by about 10 degrees. So, in order to obtain uniform gloss having e.g. glossiness of the order of 30, on the basis of the relation shown in FIG. 3, the bearing amount of the transparent toner at which the gloss does not change even when the fixing temperature is changed by 10 degrees is calculated. Specifically, the bearing amount of the transparent toner on a portion corresponding to the first revolution of the fixing roller 104*g* (in which the fixing temperature is in the vicinity of 190 degrees) is set to 0.35 $mg/cm^2$, and the bearing amount of the transparent toner on a portion corresponding to the second revolution (in which the fixing temperature is in the vicinity of 180 degrees) is set to 0.62 $mg/cm^2$, whereby uneven gloss can be improved and be made inconspicuous. Incidentally, in the present embodiment, the bearing amount (a maximum value) of the normal toner image is 1.2 $mg/cm^2$. As a result, the transparent toner image of the above-described bearing amount is formed on a non-image portion, on which such a normal toner image is not formed so that the recording material is exposed, to reduce a difference in glossiness between the image portion and the non-image portion.

Here, even in a case where use is made of an area in which an increase in gloss is saturated relative to an increase in the bearing amount, as is apparent from FIG. 3, when the fixing temperature is lowered as much as 10 degrees from e.g. 190 degrees, the gloss obtained at the fixing temperature of 190 degrees cannot be reached even if the bearing amount is increased. In such a case, however, as in the present embodiment, the bearing amount of the transparent toner during the first revolution is set to a smaller amount than the bearing amount of the transparent toner during the second revolution, whereby the gloss does not change depending on the fixing temperature, but an image of uniform gloss can be obtained.

Figure 7:
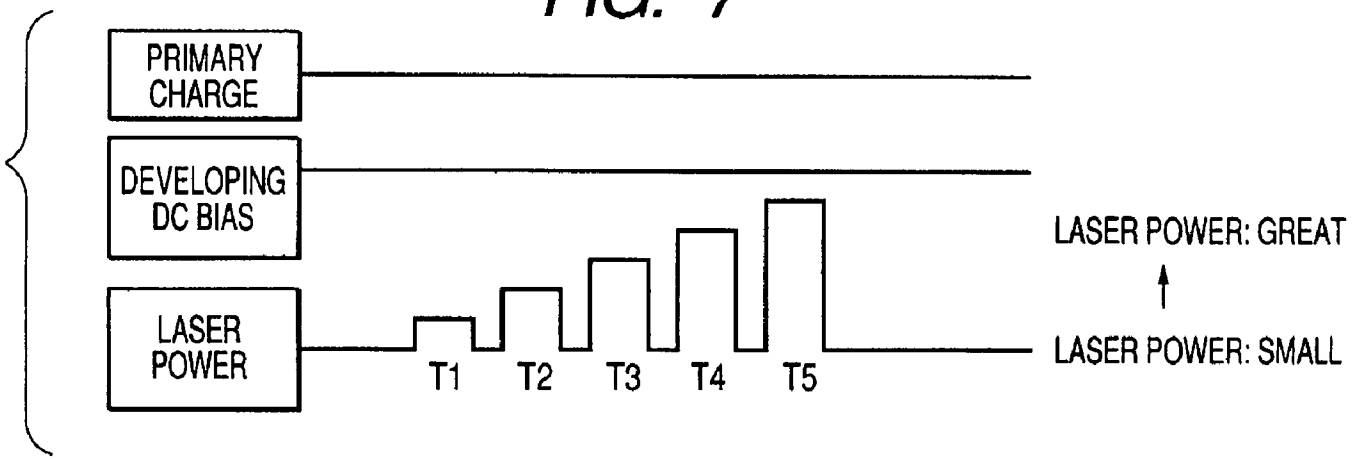
FIG. 7 is a control sequence chart of patch image formation in Embodiment 3.

A method of changing the bearing amount of the transparent toner in the present embodiment is to adjust the electric potential of the electrostatic image formed on the image bearing member by the latent image forming means (change the intensity of image exposure) to thereby the electric potential difference (developing DC bias) from the developing means for the transparent toner, and change the bearing amount (for example, the conceptual view of FIG. 7). That is, the electric potential of the electrostatic image on image forming areas corresponding to a portion corresponding to the first revolution of the fixing roller 104*g* and a portion corresponding to the second revolution thereof is changed in expectation of the fall of the fixing temperature. The method of changing the bearing amount of the transparent toner may be the following method. For example, a condition for forming a transparent toner image may be coped with by adjusting the electric potential of the developing means for the transparent toner (developing DC bias) to thereby change the electric potential difference from the electrostatic image, namely, adjust the so-called developing contrast.

Also, in a case where the bearing amount of the transparent toner corresponding to the portion corresponding to the first revolution of the fixing roller and the portion corresponding to the second revolution thereof becomes a difference in glossiness, it is preferable to gradually stepwisely change the bearing amount of the transparent toner on a boundary portion in which this bearing amount changes (which corresponds to the boundary portion between the first revolution and the second revolution of the fixing roller) in order to alleviate the feeling of physical disorder due to such a difference in glossiness.

It is also conceivable to change the bearing amounts of the colored toners (in the present embodiment, yellow, magenta, cyan and black toners) without using the transparent toner (or without changing the bearing amount of the transparent toner), but in this case, not only the gloss but also the color developing property changes, and this cannot become preferable means for improving glossiness. On the other hand, as described above, the construction of the present embodiment is more desirable in being capable of changing the bearing amount of the transparent toner by the utilization of the transparent toner which is not concerned in the color taste and color developing property of the image when reproducing the image of an original, to thereby "selectively" effecting an improvement in glossiness. That is, the toner for gloss need not be the transparent toner if it does not hinder the color taste and color developing property of the image when reproducing the image of the original. For example, when the recording material is white, a white toner may be used as the toner for gloss.

While in the present embodiment, description has been made of the bearing amounts of the transparent toner during the first revolution and the second revolution of the fixing roller, in the case of large size paper such as, for example, A3 size paper, there can be sufficiently conceived a case where the fixing roller contacts during three or more revolutions on end. Again in that case, as in the present embodiment, a proper bearing amount of the transparent toner can be selected in accordance with the actually measured/foreseen value of the fixing temperature during the third revolution to thereby obtain an image of good quality having a uniform glossy feeling. For example, the condition for forming a transparent toner image is changed so that the bearing amount of the transparent toner image per unit area on the recording material may become great each time that surface of the fixing roller 104*g* which contacts with the recording material 102 makes one revolution, whereby an image having little uneven gloss can be obtained even in the case of large size paper for which the fixing roller need make three or more revolutions to fix the whole surface.

While in the present embodiment, there has been shown a case where the fixing temperature changes from 190 degrees to 180 degrees, of course, the temperature condition is not restricted thereto. Also, as in the present embodiment, the temperature change is foreseen and controlled in advance by feed forward, but the following technique may be adopted.

For example, when a normal toner image formed on a recording material is fixed, the temperature transition of a fixing roller is automatically detected by the use of a thermister (detecting means) for adjusting the temperature of the fixing roller used for the control of the electric power supply to the above-described halogen heater. Then, it is a technique in that the CPU 300 (setting means) sets the bearing amount of the transparent toner on the basis of the result of this temperature transition measurement. Furthermore, the CPU 300 sets the image forming condition of a transparent toner image for achieving that. That is, it is a technique of actually measuring the temperature fall transition during the first revolution and the second (subsequent) revolution of the fixing roller in a certain image forming job by the thermister, storing data indicative of this temperature fall transition in a memory as storage means, and feeding back this to the next image forming job by a CPU 300 as controlling means. By adopting this technique, it is possible to properly cope with even a case where the falling temperature during the first revolution and the second (subsequent) revolution of the fixing roller is changed by the situation of the apparatus, and it is possible to prevent uneven gloss from occurring to an image stably for a long period.

As described above, in the present embodiment, in order to suppress any change in the glossiness of the image resulting from any change in the temperature of the fixing roller during the fixing process, the CPU (changing means) 300 changes the bearing amount of the transparent toner image formed on the recording material, irrespective of the inputted image information.

Thus, the uneven gloss occurring at the fixing step due to any change in the fixing temperature of the fixing roller, for example, the uneven gloss due to the fixing temperature difference between the first revolution and the second revolution of the fixing roller can be improved by changing the bearing amount of the transparent toner, to thereby provide an image having highly uniform gloss.

Embodiment 2

In Embodiment 2, the uneven gloss of an image occurring due to the so-called non-sheet passing portion temperature rise resulting from recording materials of a small width direction size continuously passing through the fixing apparatus is suppressed. That is, in the case of a small size recording material, the uneven gloss due to the fixing temperature difference between the central portion of the fixing roller in the width direction thereof (the area which contacts with the recording material) and the opposite end portions of the fixing roller (the areas which do not contact with the recording material) is suppressed by changing the bearing amount of the transparent toner. Embodiment 2 is similar to Embodiment 1 in that by thus changing the bearing amount of the transparent toner, the glossiness of the image attributable to the temperature fall of the fixing roller due to the recording material is improved. In Embodiment 2, construction similar to those in Embodiment 1 need not be described.

When for example, use is made of a recording material (e.g. an envelope) of which the usable size in the width direction is smaller than that of the largest recording material, temperature fall occurs in the area of the fixing roller which has contacted with the recording material in the longitudinal direction (width direction of the fixing roller, but the area of the fixing roller which is more adjacent to the longitudinal end portion than this area does not contact with the recording material and therefore causes a temperature rise (the so-called non-sheet passing portion temperature rise). This is because substantially uniform heat the heater effects generation in the entire area of the fixing roller in the longitudinal direction thereof so as to cope with a recording material of a maximum size.

Figure 4:
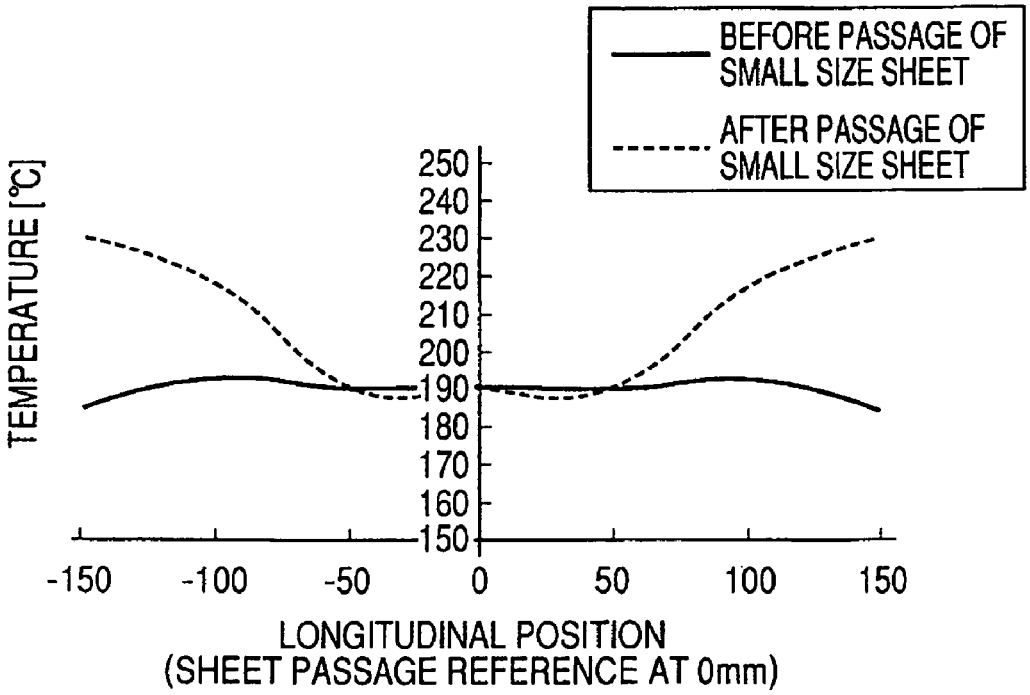
FIG. 4 shows the relation between a longitudinal position indicative of the temperature rise of an end portion and the temperature.

FIG. 4 shows the temperature distribution of the fixing roller in the longitudinal direction thereof after a small size sheet has been passed through the fixing apparatus. The reference zero at the longitudinal position on the axis of abscissas shows that the conveyance reference of the recording material in the width direction thereof is the center of the fixing roller in the longitudinal direction thereof. FIG. 4 shows the experimental value when 50 sheets of which the size in the width direction is a small size of 100 mm have been passed through the fixing apparatus. It will be seen that as shown in FIG. 4, relative to the temperature distribution (solid line) of the fixing roller in the longitudinal direction thereof before the small size sheets are passed, the temperature distribution (broken line) after the small size sheets have been passed has remarkably risen in temperature in the opposite end portions of the fixing roller as compared with the central portion thereof.

In the present embodiment, in order to eliminate the uneven gloss of the image attributable to such a temperature rise of the end portions of the fixing roller, when the image is to be fixed by the fixing roller having the temperature distribution indicated by broken line in FIG. 4, the bearing amount of the transparent toner is changed in the width direction on the basis of the relation shown in FIG. 3. Specifically, the condition for forming a transparent toner image is controlled by the CPU 300 so that the bearing amount of the transparent toner image per unit area on the recording material may become smaller on the end portions of the recording material than on the central portion of the recording material in the width direction thereof.

The temperature distribution of the fixing roller may be measured by detecting means for conjecturing any temperature change from such conditions as the size, number and kind of passed small size sheets, and the time from after the small size sheets have been all passed until an image is formed on a large size sheet. Also, the temperature distribution of the fixing roller in the longitudinal direction thereof may be measured by the use of some technique (e.g. a plurality of thermistors as detecting means juxtaposed in the longitudinal direction) to thereby detect the temperature difference between the center and the end portions of the fixing roller. Controlling means can control the bearing amount of the transparent toner image on the basis of the conjected temperature or the detected temperature, i.e., the temperature change of the fixing roller to thereby improve the uneven gloss due to the temperature change of the fixing roller in the width direction thereof.

Thus, even if a temperature rise occurs to the end portions of the fixing roller with the passage of the small size sheets, the uneven gloss of the image can be suppressed from occurring to the large size sheet on which an image is formed thereafter. As described above, again in the present embodiment, the bearing amount of the transparent toner can be changed to thereby improve glossiness and enhance the quality of image.

Embodiment 3

Embodiment 3, as a more preferable aspect of Embodiment 1, has as its object to form a transparent toner image so as to assume a proper bearing amount of transparent toner even if any fluctuation occurs to the kind of the recording material, the atmospheric environment (temperature) of the image forming apparatus, and the temperature transition situation of the fixing roller during image formation, thereby providing an image of high gloss. In the present embodiment, there is executably designed a setting mode for actually experimentally forming a transparent toner image on a recording material selected by a user and automatically measuring the glossiness thereof to thereby set the image forming condition (bearing amount) of the transparent toner used for the image formation thereafter. This setting mode can be carried out by the use through the liquid crystal operating portion of the image forming apparatus. At that time, design is made such that the user indicates (the kind of) a recording material to be used in the setting mode through the liquid crystal operating portion. Constructions similar to those in Embodiment 1 need not be described.

Figure 5A:
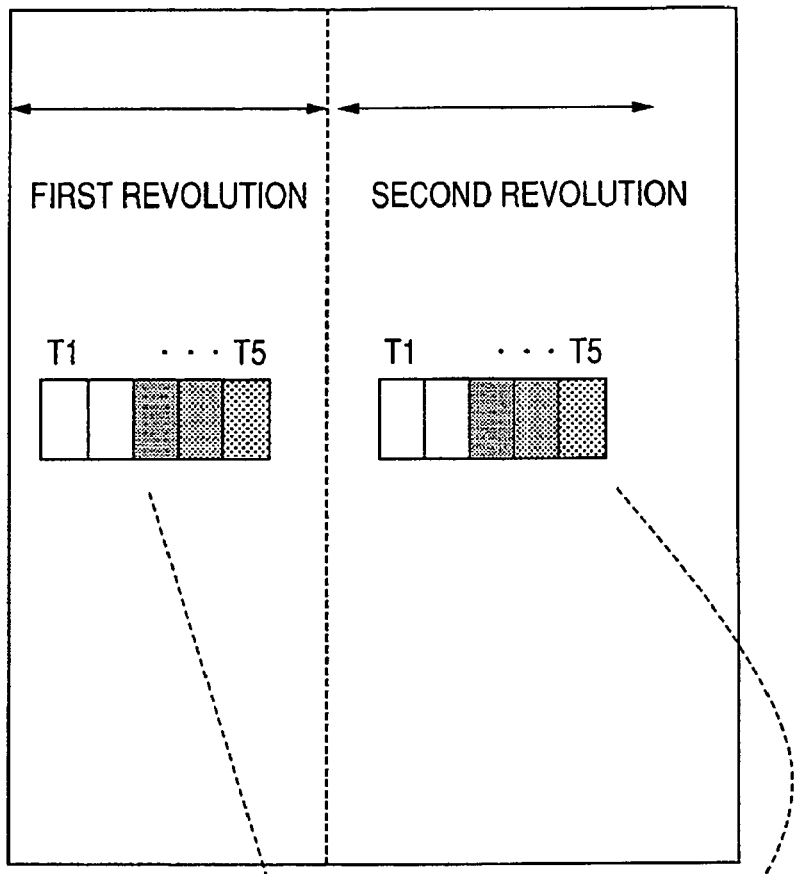
FIGS. 5A and 5B are conceptual views showing a measuring and controlling method in Embodiment 3.
Figure 5B:
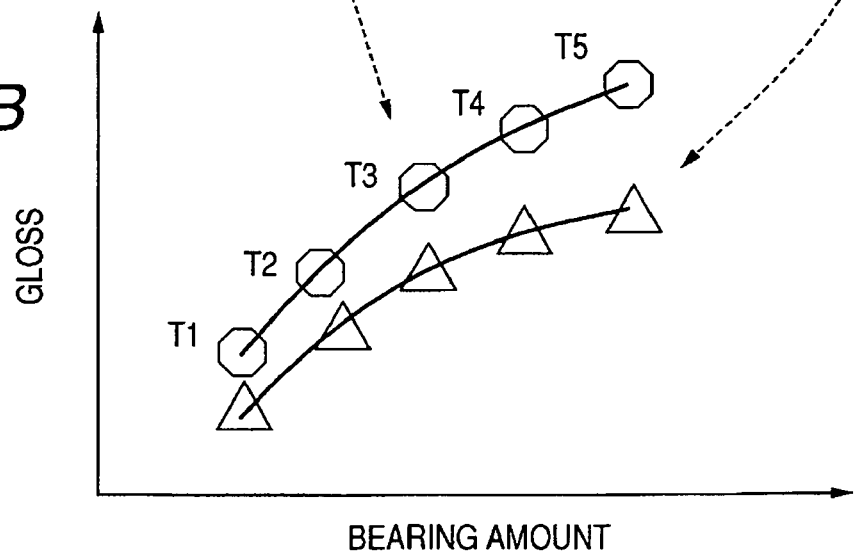

FIG. 5A shows each patch image formed on the recording material, and respective groups of patch images are formed at positions corresponding to the first revolution and second revolution of the fixing roller. FIG. 5B shows the relation between the bearing amount and gloss of each patch image in a group of patch images.

First, as shown in FIG. 5A, five kinds of images for reference (hereinafter referred to as the patch images) differing in image forming conditions (electrostatic latent image condition and developing condition) (differing in the bearing amount of the toner per unit area) from one another are formed by the transparent toner on the portions of the recording material 102 respective ones of selected by the user which corresponds to the first revolution and the second revolution of the fixing roller.

Next, the gloss of each path image is measured by the use of a glossiness sensor 110 as measuring means for measuring the glossiness of the toner image on the recording material fixed by the fixing roller 104*g*. The CPU (setting means) 300 receives the input of a signal corresponding to the glossiness, and compares these five glossiness data and glossiness data to be a target with one another to thereby select the image forming condition, and set the image forming condition for the transparent toner image used during the ordinary image formation thereafter. The glossiness sensor 110 is disposed in the image forming apparatus main body (see FIG. 1).

Figure 6:
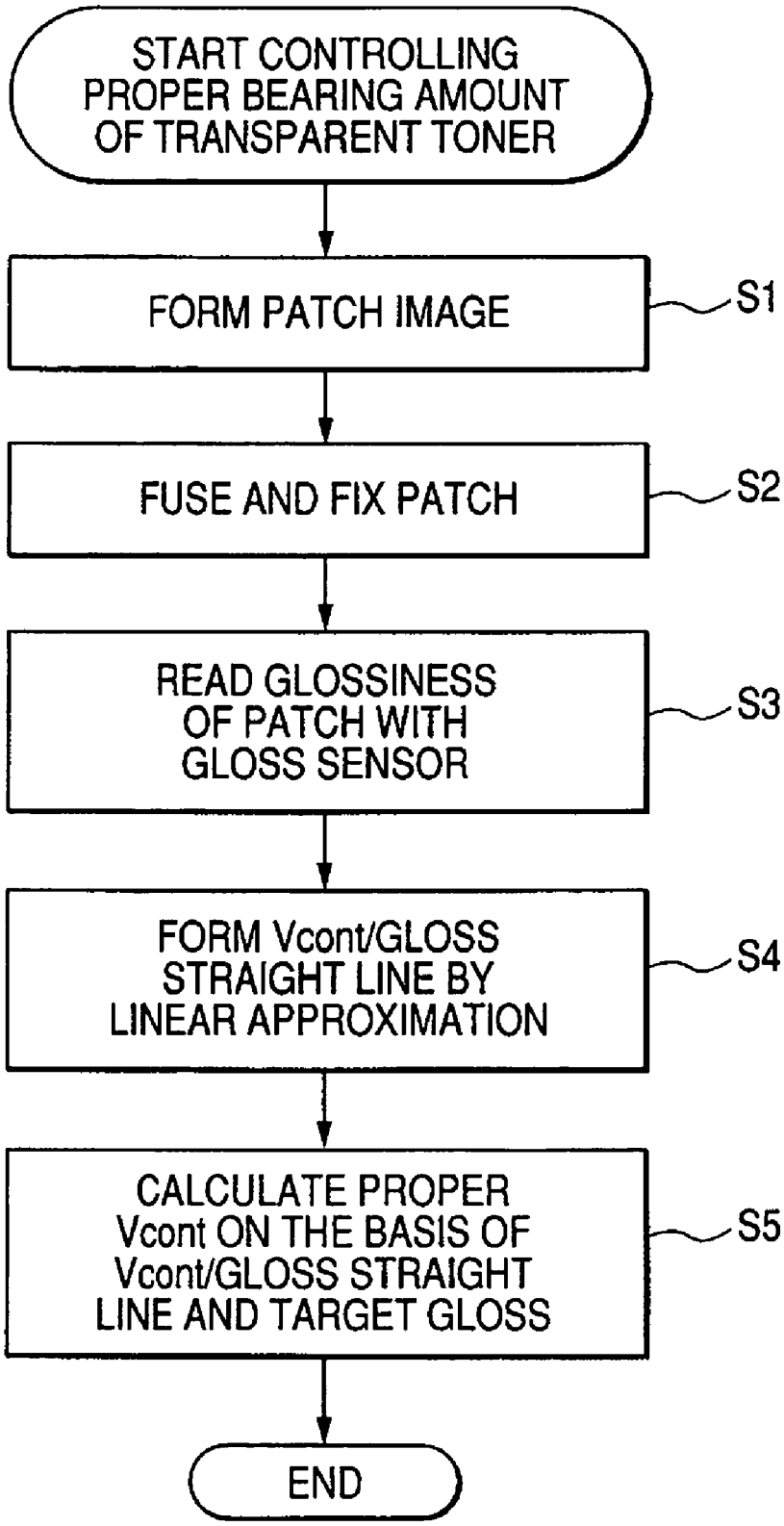
FIG. 6 is a flow chart of the control in Embodiment 3.

The control of the present invention will be shown below in detail with reference to the flow chart of FIG. 6. The control of the proper bearing amount of the transparent toner is started by the instructions to execute the above-described setting mode.

First, the image forming condition, in the present embodiment, five kinds of patch images T1 to T5 differing only in image exposure condition from one another are formed on respective areas corresponding to one revolution of the fixing roller by the transparent toner (S1). Here, the image forming condition refers to the difference value (hereinafter referred to as the developing contrast) between the electric potential of the image-exposed portion on the photosensitive drum and the developing DC bias, and this developing contrast is changed by intervals of 25V, and thus 100V in total, to thereby form five patch images.

Then, each patch image on the recording material is fused and fixed by the fixing roller (S2).

Figure 8:
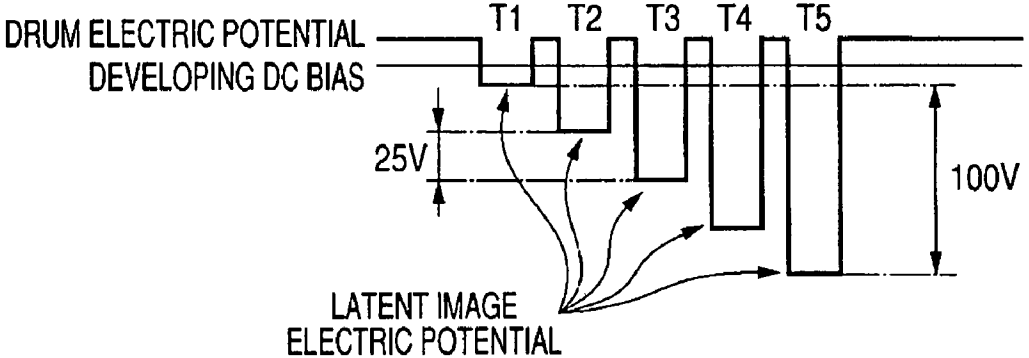
FIG. 8 is a conceptual view showing a change in electric potential during the control in Embodiment 3.

FIGS. 7 and 8 show conceptual views of the control and electric potential when the patch images are formed. As shown in FIG. 7, in the present embodiment, the developing DC bias applied to the primary charging device which is charging means and transparent toner forming means is controlled so as to be constant during the setting mode, and the image exposure intensity (laser power) of the latent image forming means is made different among the patch images T1 to T5 to thereby form five kinds of patches differing in the image forming condition from one another. FIG. 8 shows a conceptual view of the electric potential and developing contrast of the photosensitive drum during the setting mode. As shown in FIG. 8, about the patch images T1 to T5, five kinds of developing contrasts are formed by five kinds of latent image electric potential (electric potential of the image-exposed portion) and a constant developing DC bias.

The formed five patch images T1 to T5 are fused and fixed by the fixing means, whereafter the glossiness of the transparent toner image fixed by the fixing roller 104*g* in the first revolution thereof and the glossiness of the transparent toner image fixed by the fixing roller 104*g* in the second revolution thereof are measured in the named order by the glossiness sensor 110, and a signal indicative of glossiness corresponding to the patch images T1 to T5 is transmitted to the CPU 300 (S3, see FIG. 5B).

Figure 9:
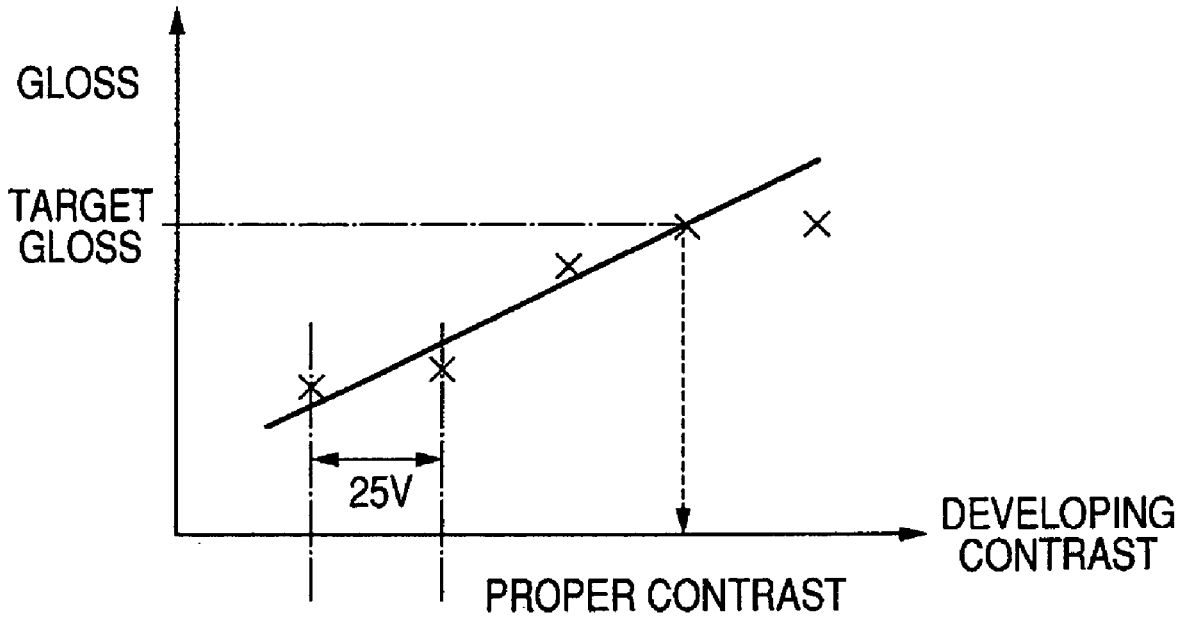
FIG. 9 is a graph showing the relation between a developing contrast and gloss in Embodiment 3.

Further, FIG. 9 shows a conceptual view for calculating a proper developing contrast from the above-described five patches in the present embodiment. FIG. 9 shows the developing contrast on the axis of abscissas, and the glossiness by the glossiness sensor 110 on the axis of ordinates. For example, with the presently set developing contrast as the center value, as shown in FIG. 8, the developing contrast is made different at two points at intervals of 25 V on the plus side and likewise at two points on the minus side, and a patch image of 25 mm in the recording material conveying direction and 10 mm in a direction perpendicular to the conveying direction is formed. Thereupon, as the developing contrast is heightened, the bearing amount of the transparent toner is also increased, and the unevenness of the recording material is gradually filled, whereby the glossiness rises. By utilizing this characteristic, it is possible to determined the glossiness to be the target, and extract a developing contrast necessary and sufficient to achieve this target glossiness by the CPU 300. In the present embodiment, five points of sampling is approximated to a linear shape, and the point of intersection between the obtained straight line and the target glossiness is set (stored in a memory as storage means) as a proper developing contrast value by CPU 300 (S4 and S5).

The CPU 300 uses the data stored in the above-mentioned memory as the image forming condition (developing contrast) for the transparent toner image in the image formation thereafter, whereby the bearing amount is made proper.

Also, by carrying out the above-described setting mode (control of the proper bearing amount), as shown in the conceptual view of FIG. 5B, it becomes possible to calculate and control the relation between the bearing amount and gloss of the transparent toner according to the fixing condition at that point of time, the working atmosphere of the image forming apparatus, and further the information of the kind of the recording material of which the inputted image output is desired by the user. In the present embodiment, on the basis of the aforedescribed result, as in Embodiment 1, the bearing amount of the transparent toner can be made proper in accordance with the temperature change of the fixing roller, e.g. the change in the fixing temperature of the fixing roller between the first revolution and second revolution thereof, to thereby suppress the occurrence of uneven gloss due to the temperature of the fixing roller, and achieve a uniform glossy feeling.

Also, design may be made such that by detecting means for detecting the kind of the recording material, the toner amount per unit area of the toner image for gloss is changed in accordance with the kind of the recording material from the result of the detection.

While each of the above-described embodiments is that of an image forming apparatus having a transparent toner image forming portion as a portion of an image forming apparatus by colored toners, the transparent toner image forming portion is not restricted thereto, but may be, for example, of a construction in which another unit for forming a transparent toner image on the recording material after the image formation by colored toners has all been completed is discretely provided besides the colored image forming apparatus.

Also, as a so-called tandem type image forming apparatus, there may be adopted a construction in which an image forming station for the transparent toner is provided besides an image forming station for colored toners.

Also, as the controlling means for controlling the bearing amount of the transparent toner image formed on the image bearing member in each of the above-described embodiments, various ones such as software-like means and hardware-like means can be suitably selected and used. For example, the relations among the fixing temperature, the glossiness and the transparent toner image forming condition are made into a table in advance, and the table is stored in storage means, and the optimum transparent toner image forming condition is suitably selected from measured information, and on the basis thereof, control may be effected. Alternatively, a calculation expression indicative of the relations among the fixing temperature, the glossiness and the transparent toner image forming condition is stored in advance, and the optimum transparent toner image forming condition is calculated by calculating means, and on the basis thereof, control may be effected.

The measurement of the glossiness in each of the above-described embodiments has its image glossiness value based on the 60° mirror surface glossiness by JIS, and was effected by the use of a gloss checker IG-320 (registered trademark: produced by HORIBA, Ltd.) According to the construction of each of the above-described embodiment, the occurrence of uneven gloss when the glossiness of an image is improved by the use of a toner for gloss can be suppressed.

It is possible to change the various constructions described in the above-described embodiments to other known construction within the scope of the technical idea of the present invention.

This application claims priority from Japanese Patent Application No. 2005-057009 filed Mar. 2, 2005, which is hereby incorporated by reference herein.

What is claimed is:

1. An image forming apparatus comprising:

first image forming means for forming a first toner image on a recording material on the basis of image information;

second image forming means for forming a second toner image on an area of the recording material on which the first toner image is not formed to improve a glossiness of the image;

image heating means for heating the first and second toner images on the recording material in a nip portion; and changing means for changing a toner amount per unit area of the second toner image to suppress a change in the glossiness of the image resulting from a change in temperature of said image heating means.

2. An image forming apparatus according to claim 1, wherein said changing means makes the toner amount within a region of the image formed on single recording material.

3. An image forming apparatus according to claim 2, wherein said changing means gradually changes the toner amount within a region of the image.

4. An image forming apparatus according to claim 1, further comprising detecting means for detecting a glossiness of a toner image for reference, and setting means for setting the toner amount in accordance with the glossiness detected by said detecting means.

5. An image forming apparatus according to claim 1, wherein a toner used for formation of the second toner image is a transparent toner.

6. An image forming apparatus comprising:

first image forming means for forming a first toner image on a recording material on the basis of image information;

second image forming means for forming a second toner image on an area of the recording material on which the first toner image is not formed to improve a glossiness of the image;

image heating means for heating the first and second toner images on the recording material in a nip portion; and changing means for changing a toner amount per unit area of the second toner image, said changing means makes the toner amount smaller on a leading end side of the recording material in a conveying direction of the recording material than on a trailing end side of the recording material in the direction.

7. An image forming apparatus according to claim 6, wherein said changing means gradually changes the toner amount.

8. An image forming apparatus according to claim 7, wherein a toner used for formation of the second toner image is a transparent toner.

9. An image forming apparatus comprising:

first image forming means for forming a first toner image on a recording material on the basis of image information;

second image forming means for forming a second toner image on an area of the recording material on which the first toner image is not formed to improve a glossiness of the image;

image heating means for heating the first and second toner images on the recording material in a nip portion; and changing means for changing a toner amount per unit area of the second toner image, said changing means makes the toner amount smaller on a end portion of the recording material in a width direction of the recording material than on a central portion of the recording material in the direction.

10. An image forming apparatus according to claim 9, wherein when a width of a recording material on which an image is formed by this time image forming job is wider than a width of a recording material on which an image has been formed by a previous time image forming job, said changing means changes the toner amount, and when a width of a recording material on which an image is formed by this time image forming job is narrower than a width of a recording material on which an image has been formed by a previous time image forming job, said changing means does not change the toner amount.

11. An image forming apparatus according to claim 9, wherein said changing means gradually changes the toner amount.

12. An image forming apparatus according to claim 9, wherein a toner used for formation of the second toner image is a transparent toner.

* * * * *

UNITED STATES PATENT AND TRADEMARK OFFICE

CERTIFICATE OF CORRECTION

PATENT NO. : 7,421,231 B2
APPLICATION NO. : 11/350875
DATED : September 2, 2008
INVENTOR(S) : Yuji Bessho It is certified that error appears in the above-identified patent and that said Letters Patent is hereby corrected as shown below:

TITLE PAGE

ITEM [56], References Cited

FOREIGN PATENT DOCUMENTS:

"JP 2005055517 A * 3/2005" should read --JP 2005-055517 A * 3/2005--.

OTHER PUBLICATIONS:

"Notification od Reason" should read --Notification of Reason--.

ITEM [57], ABSTRACT:

"12 Claims, 7 Drawing Sheets" should read --8 Claims, 7 Drawing Sheets--.

COLUMN 3:

Line 15, "described" should be deleted.

COLUMN 4:

Line 16, "portions" should read --portions of--.
Line 28, "differences" should read --difference--.
Line 63, "toner are" should read --toners are--.

COLUMN 5:

Line 32, "104gis" should read --104g is--.
Line 45, "revolutions" should read --revolution--.

COLUMN 6:

Line 20, "unit are" should read --unit area--.

COLUMN 7:

Line 36, "to thereby the" should read --to thereby change the--.

COLUMN 9:

Line 35, "roller," should read --roller),--.
Line 40, "heat" should read --heat from--.

UNITED STATES PATENT AND TRADEMARK OFFICE

CERTIFICATE OF CORRECTION

PATENT NO. : 7,421,231 B2
APPLICATION NO. : 11/350875
DATED : September 2, 2008
INVENTOR(S) : Yuji Bessho It is certified that error appears in the above-identified patent and that said Letters Patent is hereby corrected as shown below:

COLUMN 11:

Column 11, line 1:

"respective ones of selected by the user" should read --respective ones of the patch images selected by the user--.

COLUMN 12:

Line 6, "determined" should read --determine--.

COLUMN 13:

Line 7, "Ltd.) According" should read --Ltd.). ¶According--.

Line 35, "makes" should read --changes--.

COLUMN 14:

Claims 9 to 12 should be deleted.

Signed and Sealed this

Eleventh Day of August, 2009

David J. Kappos

David J. Kappos
*Director of the United States Patent and Trademark Office*